US005931114A

United States Patent [19]

Bartholomew

[11] Patent Number: 5,931,114

[45] Date of Patent: Aug. 3, 1999

[54] BOAT TOP

[76] Inventor: Mark Bartholomew, 2820 Bardswood La., Tallahassee, Fla. 32310

[21] Appl. No.: 08/972,083

[22] Filed: Nov. 17, 1997

[51] Int. Cl.[6] ..... B63B 17/00

[52] U.S. Cl. ..... 114/361; 296/102

[58] Field of Search ..... 114/361, 343; 135/88.01, 121; 296/100.03, 100.04, 100.18, 102, 163

[56] References Cited

U.S. PATENT DOCUMENTS

| | | | |
|---|---|---|---|
| 2,833,296 | 5/1958 | Woodruff | 135/6 |
| 3,285,258 | 11/1966 | Hage et al. | 135/6 |
| 3,312,990 | 4/1967 | Lapworth | 9/1 |
| 4,582,016 | 4/1986 | Hansen | 114/361 |
| 5,016,558 | 5/1991 | Oehler | 114/361 |
| 5,044,298 | 9/1991 | Pepper et al. | 114/361 |
| 5,697,320 | 12/1997 | Murray | 114/361 |

*Primary Examiner*—Jesus D. Sotelo
*Attorney, Agent, or Firm*—Peter Loffler

[57] ABSTRACT

A top for attachment to the frame of a boat is comprised of at least one panel member having a plurality of T-tracks arranged in spaced apart generally rectangular orientation. At least one body member is adapted to slide along each T-track and has a brake for inhibition of the sliding action. An adapter clip is attached to each body member for removable attachment of the top to the frame and additional adapter clips can be attached directly to the top for further attachment of the top to the frame.

22 Claims, 4 Drawing Sheets

BOAT TOP

BACKGROUND OF THE INVENTION

1. Field of the Invention

The present invention relates to a rigid boat top for attachment to a boat frame.

2. Background of the Prior Art

Current boats, such as Bimini-class sailing vessels, have a soft top made from canvas or similar material that is secured to a frame. These tops, although providing protection from the elements, have several disadvantages. Once installed, a soft top may become unstable in adverse weather conditions. Furthermore, a canvas top has a relatively short life span, becoming cracked and brittle and may also leak, sometimes after just a few months of use. A soft top cannot support other accessories such as map storage compartments.

Therefore, there is a need in the art for a water vessel top that can attach to the vessel's existing frame and that overcomes the above limitations. Such a top will be easy to install and remove and will not become unstable in adverse conditions. Ideally, the top will be relatively easy to transport and store. The top will have a relatively long useful life and will provide support for other accessories.

SUMMARY OF THE INVENTION

The boat top of the present invention addresses the aforementioned needs in the art. The boat top is rigid and can be installed onto the existing bimini frames of most water vessels. Installation and removal of the boat top is relatively simple and straightforward and can be accomplished by a single person. Once installed, the boat top maintains structural integrity in almost all conditions. The materials used to construct the boat top of the present invention will provide for a relatively long useful life. Accessories, such as solar cells, liquid catchments, storage compartments and the like can be affixed to the boat top. The boat top of the present invention, which may be foldable, is relatively easy to store.

The boat top is comprised of at least one rigid panel member. If multiple panel members are used, they are hingedly attached—via standard hinge hardware, hook and loop material or rubber coated laminate material—to each other. The panel members may be made from any appropriate rigid material such as fiberglass, glass, plastic, metal, or the like. Furthermore, the panel members may be transparent, translucent, or opaque and may also be tinted or mirror finished to assist in search and rescue. Attached to the bottom face of the panel member are at least four T-tracks having body members adapted to slide along the track, the body member having an adapter clip extending therefrom. The adapter clips are removably attachable to the frame of a water vessel. The slidability of the body member along the T-track permits appropriate positioning of each adapter clip irrespective of the dimensions of the particular frame. An appropriate brake is located on the body member to hold the body member steady along the T-track once the adapter clip is appropriately positioned. At least one secondary attachment element may be utilized to provide additional attachment support of the panel members to the frame during adverse conditions.

Various accessories can be attached to either the top face or the bottom face of the boat top. Such accessories can include a solar cell that can charge the boat's batteries, a liquid catchment that catches rain water, and storage compartments that can hold maps, radios, and the like. Furthermore, a dodger can be snapped onto the outer periphery of the body member.

BRIEF DESCRIPTION OF THE DRAWINGS

Similar reference numerals refer to similar parts throughout the several views of the drawings.

DESCRIPTION OF THE PREFERRED EMBODIMENT

Figure 3:
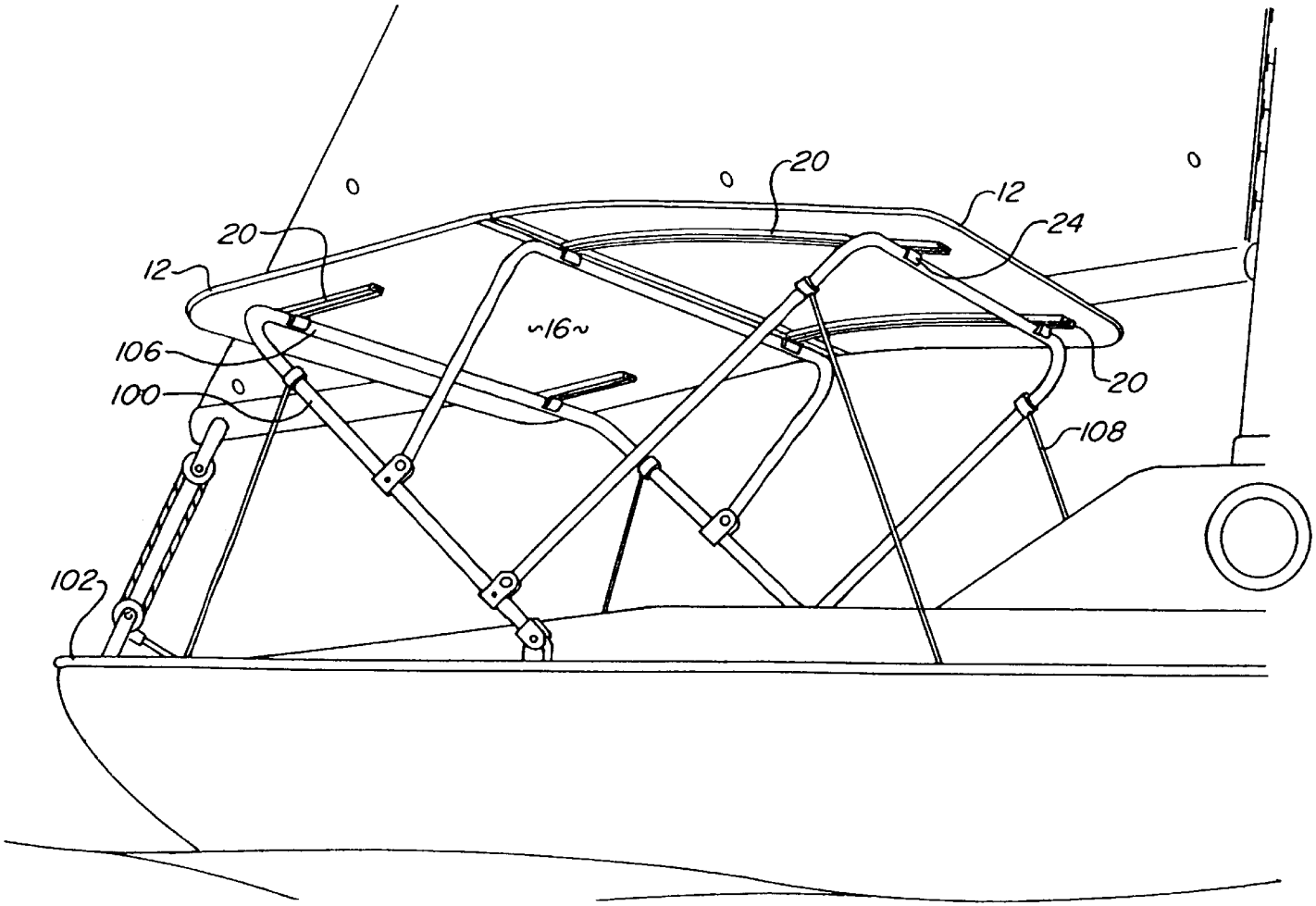
FIG. 3 is a bottom perspective view of the boat top having dual panel members.
Figure 4:
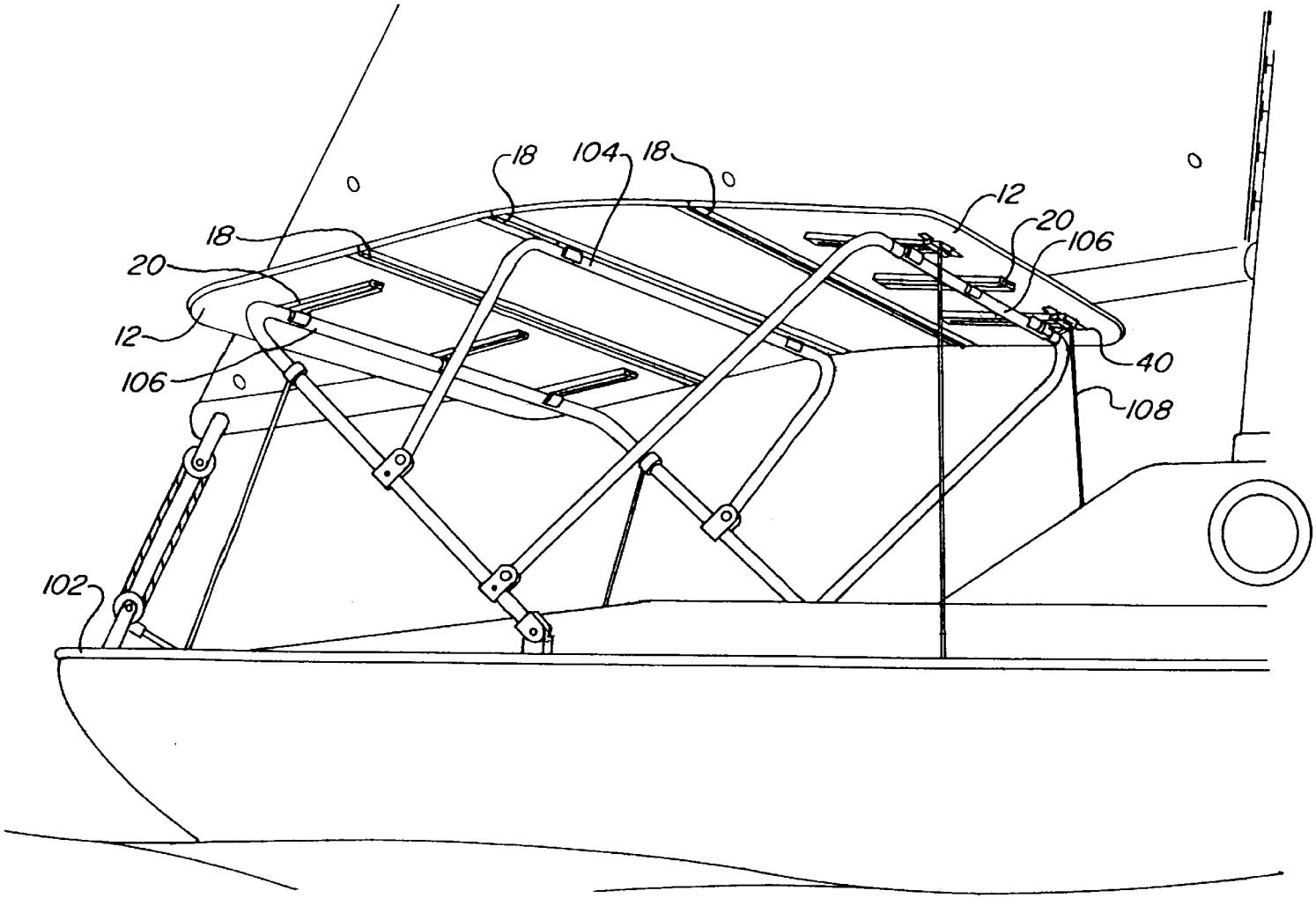
FIG. 4 is a bottom perspective view of the boat top having multiple panel members.

Referring now to the drawings, it is seen that the boat top of the present invention, generally denoted by reference numeral 10, is comprised of a panel member 12 having a top face 14 and a bottom face 16. The panel member 12 is made from a rigid material such as metal, plastic, LEXAN™ and the like and may be transparent, translucent, or opaque. As seen in FIG. 3, the boat top 10 can also be formed from two panel members 12 hingedly attached to each other, or as seen in FIG. 4, the boat top 10 can be formed from multiple panel members 12 hingedly attached to each other. The hinge element 18 may be integrally formed with the adjoining panel members 12 or may be a separate hinge that is attached to each panel member 12. If desired, a muntin (not illustrated) may be used to cover the hinge 18 for aesthetic and waterproofing qualities. As seen, the boat top 10 is bowed for proper fitting onto the existing bimini frame 100 of a boat 102. The bowing also resists device lift in a direct wind. At least four T-tracks 20 are attached to the bottom face 16 in spaced apart generally rectangular orientation. The T-tracks 20 can be of any desired length, however, longer T-tracks 20 provide greater structural support to the panel members 12. At least one body member 22 is adapted to slide along each T-track 20.

The exact configuration of the T-track 20 and the body member 22 is a matter of design choice and any configuration known in the art is understood to fall within the scope and spirit of the present invention. For example, the T-track 20 may have C-shaped channel and the body member 22 has a T-extension that slides within the C-shaped channel. Alternately, the body member 22 may have the C-shaped channel and the T-track 20 may have the T-extension that slides within the C-shaped channel. Other configurations that permit the body member 22 to slide along the T-track 20 are also possible.

An adapter clip 24 is attached to each body member 22. As seen, each adapter clip 24 is a U-shaped member that is made from a rigid material having some resiliency, such as plastic, spring metal, and the like. The adapter clip 24 is snapped onto a section of the boat's frame 100. Additional adapter clips 24 may attached directly to the bottom face 16 of the boat top 10, or to a hinge 18 for attachment to the central sections 104 of the frame 100. Alternately, as seen in FIG. 3, the adapter clips 24 that attach to the central sections 104 of the frame 100 may each be attached to a body member 22 and the body member 22 may be slidably disposed along an appropriate T-track 20. Although the boat frame 100 is illustrated as having two end sections 106 and a single central section 104, if the frame 100 has additional central sections 104, an additional number of adapter clips 24 would be provided for securing the boat top 10 to these additional central sections 104.

Figure 6:
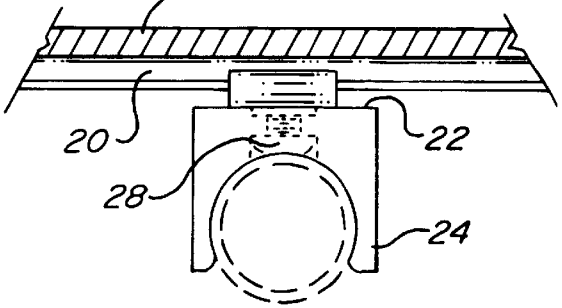
FIG. 6 is a side view, partially cutaway of another brake utilizable with the boat top.

A brake is operatively connected to the body member 22 for inhibiting the sliding of the body member 22 relative to the T-track 20. The brake may be of any form known in the art such as the at least one knob 26, illustrated in FIG. 5, that when rotated, exerts frictional pressure onto the T-track 20 thereby inhibiting movement of the body member 22. Counterrotation of the knob 26 releases the frictional pressure and permits body member 22 sliding. The braking action of the brake may be exerted on one side of the adapter clip 24 or for a more uniform and stable action, on both sides of the adapter clip 24. Alternately, as seen in FIG. 6, a screw 28 may threadably pass through the adapter clip 24 and a corresponding hole (not illustrated) on the body member 22 for frictional pressure exertion onto the T-track 20.

Figure 1:
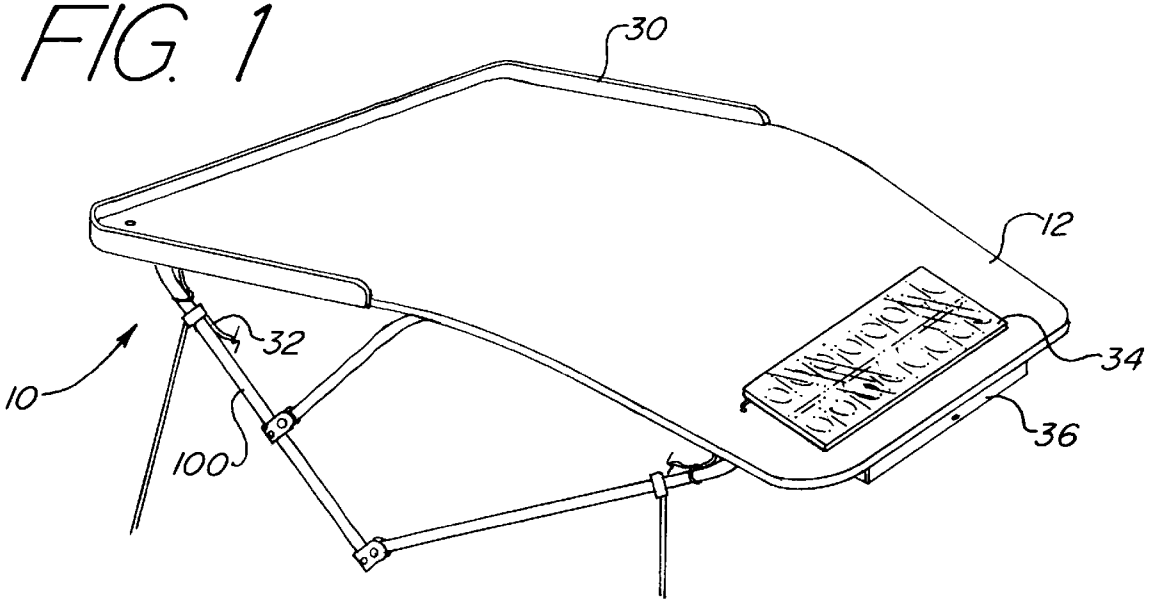
FIG. 1 is a top perspective view of the boat top of the present invention.
Figure 2:
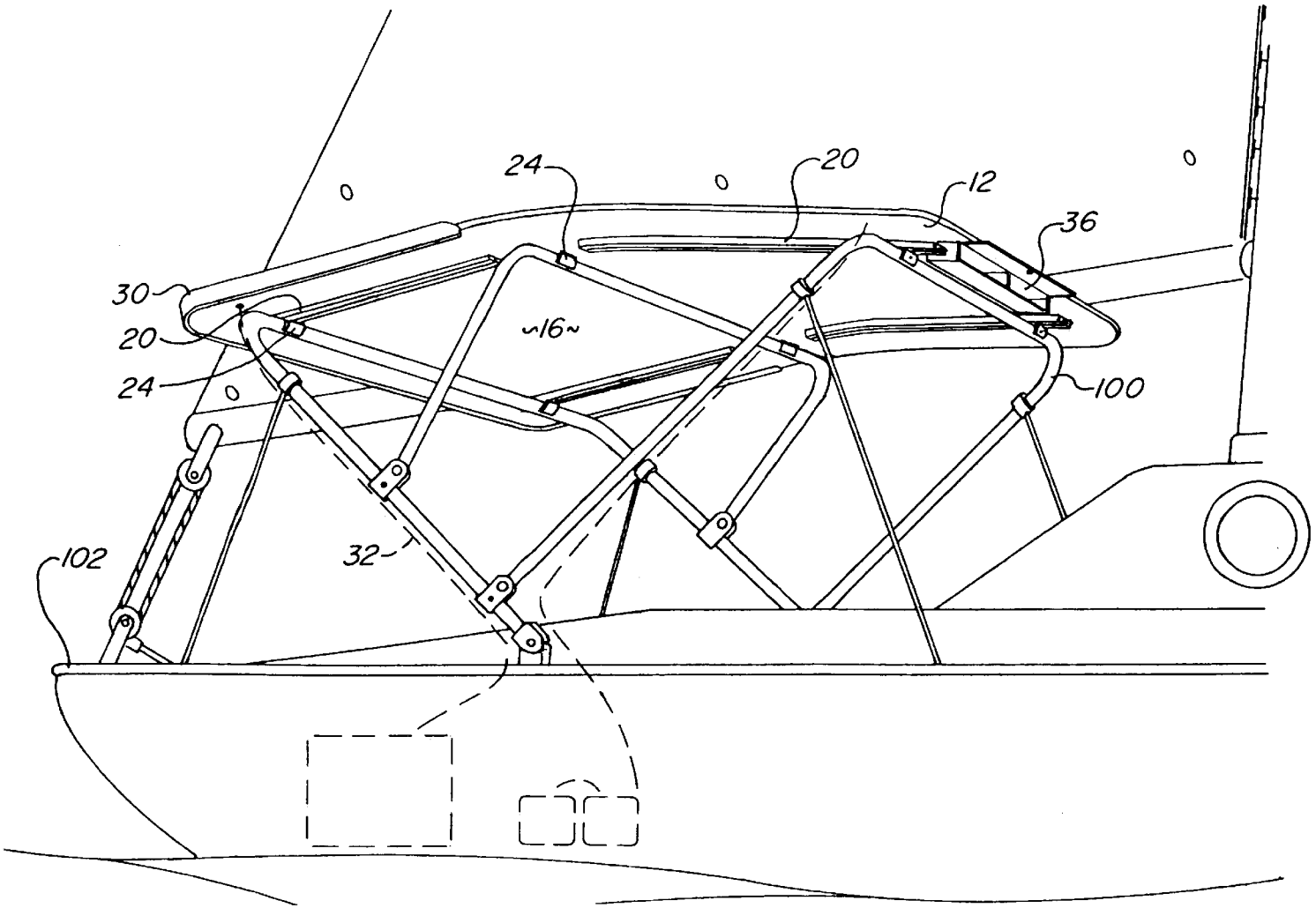
FIG. 2 is a bottom perspective view of the boat top of the present invention.

As seen in FIG. 1, a flange 30 can extend upwardly from the panel member 12, either from the top face 14, or as illustrated, from the outer periphery of the panel member 12, for defining a liquid catchment. In a multiple panel member 12 configuration, the flange 30 would be confined to one of the panel members 12. A drain tube 32 extends from the liquid catchment for draining liquid therefrom. As also seen in FIG. 1, a solar panel 34 can be attached to the top face 14 of the boat top 10 for providing electrical power to selected accessories on the boat 102 or for charging the batteries on board. As seen in FIG. 2, at least one storage compartment 36 can be attached to the bottom face 16 of the boat top 10 for storing desired items, such as radios, navigational aids, books, maps, etc. The storage compartments 36 can be open, as illustrated, or can have an appropriate cover for securing the items stored therein from the elements.

In order to utilize the boat top 10 of the present invention, the boat top 10 is positioned over the frame 100 of a boat 102. In a dual or multiple panel configuration, the boat top 10 is initially unfolded. Each adapter clip 24 is aligned with its respective frame section. The body members 22 are slid into position to permit proper adapter clip 24 alignment with the respective end section 106 of the frame 100. Thereafter, each adapter clip 24 is snap fit onto its respective frame section. The brake on each body member 22 is engaged to prevent body member 22 movement with respect to the T-track 20 and thereby provide a stable hold.

Figure 5:
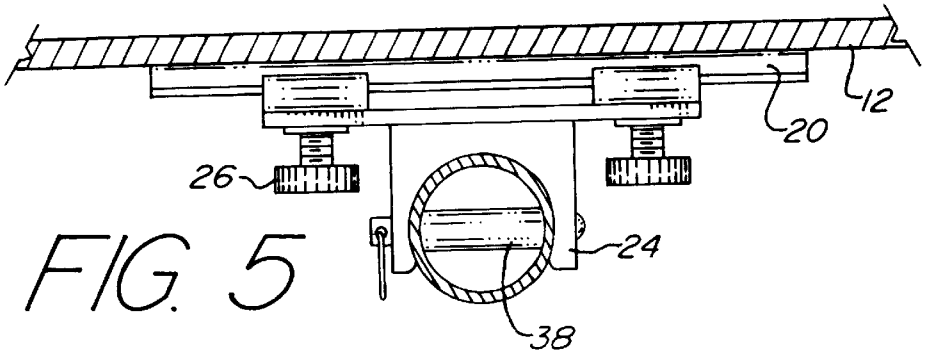
FIG. 5 is a side view, partially cutaway of a brake utilizable with the boat top.

If desired, secondary attachment elements can be provided in order to securely hold the boat top 10 to the frame 100 during adverse conditions such as high wind conditions. One such element is best illustrated in FIG. 5 wherein a pair of corresponding holes (not illustrated) on the adapter clip 24 are aligned with a second pair of corresponding holes (not illustrated) on the frame 100. A spring-loaded pin 38 passes through the two pairs of aligned holes thereby securing the adapter clip 24 to the frame 100. Alternately, an eye bracket 40 is attached to the bottom face 16 and can but need not straddle the T-track 20. The tie down strap 108 has one end attached to the frame 100 and passes through the eye bracket 40 before being tied down to the boat 102 at an appropriate location. The secondary attachment elements can be located at all appropriate spots or on just the leading edge of the boat top 10.

In order to remove the boat top 10 from the frame 100, the secondary attachment elements are and the panel members 12 are lifted so as to disengage the adapter clips 24 from the frame sections. If the boat top 10 is comprised of more than one panel member 12, the panel members 12 are folded and the device 10 is appropriately stored.

While the invention has been particularly shown and described with reference to embodiments thereof, it will be appreciated by those skilled in the art that various changes in form and detail may be made without departing from the spirit and scope of the invention.

I claim:

1. A top for attachment to a boat frame, the boat frame attached to a boat and having a plurality of one tie down straps each with one end attached to the boat frame and the opposing end attached to the boat, the top comprising:

a panel member having a top face and a bottom face;

a plurality of T-tracks, attached to the bottom face in spaced apart orientation;

a plurality of body members, each adapted to slide along one of the plurality of the T-tracks; and a plurality of first adapter clips, each attached to one of the plurality of body members, adapted to attach to the boat frame.

2. The top as in claim 1 further comprising at least one second adapter clip attached to the bottom face and adapted to attach to the boat frame.

3. The top as in claim 1 further comprising:

at least one first pair of corresponding holes located on at least one of the plurality of adapter clips;

at least one second pair of corresponding holes located on the boat frame; and at least one spring-loaded pin, each adapted to pass through an aligned one of the first pair of corresponding holes and one of the second pair of corresponding holes.

4. The top as in claim 1 further comprising a plurality of brakes, one each operatively connected to one of the plurality of body members, for inhibiting sliding of the body member along the T-track.

5. The top as in claim 1 wherein the panel member is bowed.

6. The top as in claim 1 wherein the panel member is rigid.

7. The top as in claim 1 further comprising a flange extending upwardly from the panel member and defining a liquid catchment.

8. The top as in claim 7 further comprising a drain tube extending from the liquid catchment.

9. The top as in claim 1 further comprising a solar cell attached to the top face.

10. The top as in claim 1 further comprising at least one storage compartment attached to the bottom face.

11. The top as in claim 1 further comprising at least one eye bracket attached to the bottom face.

12. A top for attachment to a boat frame, the boat frame attached to a boat and having a plurality of tie down straps each with one end attached to the boat frame and the opposing end attached to the boat, the top comprising:

a plurality of panel members, hingedly attached to each other and defining a top face and a bottom face;

a plurality of T-tracks, attached to the bottom face in spaced apart orientation;

a plurality of body members, each adapted to slide along one of the plurality of the T-tracks; and a plurality of first adapter clips, each attached to one of the plurality of body members, adapted to attach to the boat frame.

13. The top as in claim 12 further comprising at least one second adapter clip attached to the bottom face and adapted to attach to the boat frame.

14. The top as in claim 12 further comprising:

at least one first pair of corresponding holes located on at least one of the plurality of adapter clips;

at least one of second pair of corresponding holes located on the boat frame; and at least one spring-loaded pin, each adapted to pass through an aligned one of the first pair of corresponding holes and one of the second pair of corresponding holes.

15. The top as in claim 12 further comprising a plurality of brakes, one each operatively connected to one of the plurality of body members, for inhibiting sliding of the body member along the T-track.

16. The top as in claim 12 wherein the panel member is bowed.

17. The top as in claim 12 wherein each of the plurality of panel members are rigid.

18. The top as in claim 12 further comprising a flange extending upwardly from one of the panel members and defining a liquid catchment.

19. The top as in claim 18 further comprising a drain tube extending from the liquid catchment.

20. The top as in claim 12 further comprising a solar cell attached to the top face.

21. The top as in claim 12 further comprising at least one storage compartment attached to the bottom face.

22. The top as in claim 12 further comprising at least one eye bracket attached to the bottom face.

* * * * *